166-66 SR
8/13/85 XR 4,534,424

United States Patent [19]

Ramsey

[11] Patent Number: 4,534,424

[45] Date of Patent: Aug. 13, 1985

[54] RETRIEVABLE TELEMETRY SYSTEM

[75] Inventor: Mark S. Ramsey, Spring, Tex.

[73] Assignee: Exxon Production Research Co., Houston, Tex.

[21] Appl. No.: 594,605

[22] Filed: Mar. 29, 1984

[51] Int. Cl.[3] ..... E21B 7/00; E21B 47/12

[52] U.S. Cl. ..... 175/40; 166/66; 166/77.5; 166/385; 175/257

[58] Field of Search ..... 166/385, 65 R, 66, 77, 166/77.5; 175/40, 57, 257

[56] References Cited

U.S. PATENT DOCUMENTS

| | | | |
|---|---|---|---|
| 2,748,358 | 5/1956 | Johnston . | |
| 3,807,502 | 4/1974 | Heilhecker et al. | 166/385 |
| 3,825,079 | 7/1974 | Heilhecker | 166/385 X |
| 3,825,087 | 7/1974 | Heilhecker et al. | 166/385 X |
| 3,904,840 | 9/1975 | Kostelnicek . | |
| 3,913,688 | 10/1975 | Heilhecker et al. | 175/320 |
| 3,918,537 | 11/1975 | Heilhecker | 175/320 |
| 3,957,118 | 5/1976 | Barry et al. | 166/385 |
| 4,003,435 | 1/1977 | Cullen et al. | 166/385 |
| 4,051,456 | 9/1977 | Heilhecker et al. | 175/50 X |
| 4,098,342 | 7/1978 | Robinson et al. | 166/385 |
| 4,153,120 | 5/1979 | Zuvela et al. | 166/65 R X |
| 4,181,184 | 1/1980 | Scherbatskoy | 175/65 |
| 4,271,908 | 1/1981 | Robinson, Jr. et al. | 166/385 |

OTHER PUBLICATIONS

Robinson et al., "New Telemetry System Employs Unique Inside Wireline", *World Oil*, Apr. 1980, pp. 57–61.

Robinson, Jr., et al., "Exxon Completes Wireline Drilling Data Telemetry System", *Oil and Gas Journal*, Apr. 14, 1980, pp. 137–148.

Robinson, Jr., et al., "Exxon MWD Tools Yield Unexpected Downhole Data", *Oil and Gas Journal*, Apr. 21, 1980.

*Primary Examiner*—George A. Suchfield

*Attorney, Agent, or Firm*—Alan J. Atkinson

[57] ABSTRACT

A method is disclosed for installing and retaining a conductor between a surface terminal and a subsurface location in a drill string used to drill a well. One end of the conductor is lowered into the drill string and is anchored to the drill string of a subsurface location. The upper end of the conductor is taken in from the surface until the conductor is tensioned to a selected amount. The upper end of the conductor is then connected to the surface terminal. As each drill pipe section is added to the drill string to advance the depth of the well, the tension of the conductor is controlled to reduce fatigue failure of the conductor. In one embodiment of the invention, the tension of the conductor is controlled by connecting a conductor section of a selected length between the surface terminal and the upper end of the conductor.

15 Claims, 7 Drawing Figures

RETRIEVABLE TELEMETRY SYSTEM

FIELD OF THE INVENTION

The present invention relates to a method of installing and retaining a conductor between a surface terminal and a subsurface location in a drill string used to drill a well. More particularly, the present invention relates to a method of controlling the tension of the conductor as drill pipe sections are added to the drill string to advance the depth of the well.

BACKGROUND OF THE INVENTION

In oil and gas rotary drilling operations, an operator or contractor may desire to use downhole equipment to monitor subsurface conditions in a drill string used to drill a well. Various types of downhole equipment may be used to measure deviation of the well, resistivity of subsurface formations, or the pressure or temperature in the wellbore. To transmit high speed electrical signals from the downhole equipment to instrumentation at the surface, a wellbore telemetry cable can be installed in the drill string. Typically, the wellbore telemetry cable is an insulated single-conductor or multi-conductor cable armored with wire.

In early wellbore telemetry operations, a single continuous cable was initially installed between the drilling rig and the downhole equipment. One end of the cable was lowered into the drill string and was attached to downhole equipment at a subsurface location in the drill string. The other end of the cable was connected to a terminal at the surface. To advance the depth of the well, the entire cable had to be withdrawn from the drill string before each pipe section could be added to extend the length of the drill string. Because the addition of each new pipe section to the drill string required each cable to be replaced with a longer cable, the telemetry operations required a large stock of cables of varying lengths. To reduce the number of cables which were required to drill a well to a desired depth, a long cable would be installed in the drill string so that the cable was initially slackened. As drill pipe sections were added to advance the depth of the well, slack in the cable would gradually be reduced by an amount corresponding to the length of each added drill pipe section. This approach was not satisfactory because the slackened cable would tend to foul before the slack in the cable could be removed.

To reduce the need for a large supply of wellbore telemetry cables, U.S. Pat. No. 3,807,502 to Heilhecker et al. disclosed a technique for adding a new cable section to extend the length of the telemetry cable as each new pipe section was added to the drill string. Initially, a long cable was suspended from a structural support, called a spider, which was connected to the upper end of the drill string. The lower end of a cable section, which was threaded through a new drill pipe section, was connected to the upper end of the long telemetry cable. The drill pipe section was then added to lengthen the drill string, the depth of the well was advanced, and a new cable section and drill pipe section were added. Because the length of each cable section added to the telemetry cable was greater than the length of the corresponding drill pipe section added to the drill string, excess cable would accumulate in the drill string and would tend to foul. To remove the excess slack from the cable, portions of the cable were overlapped and were clamped with metal bindings.

Various techniques have been developed to store excess cable in the drill string by overlapping lengths of the cable. For example, U.S. Pat. No. 3,825,078 to Heilhecker et al. and U.S. Pat. No. 3,913,688 to Heilhecker et al. each disclosed a cable having its lower end attached to a subsurface location. Each cable was reeved around an upper sheave attached to the inside wall of the drill string and was reeved around a lower sheave to form an overlapping loop in the cable. The upper end of the cable was then connected to a surface terminal. A weight attached to the lower sheave prevented excess slack from accumulating in the cable.

A disadvantage of the overlapped cable configuration was that the lower sheave and overlapping portion of the cable tended to foul as drilling mud was pumped through the drill string. To reduce tangling of the cable with the lower sheave, U.S. Pat. No. 3,957,118 to Barry et al. disclosed a cable gripping device attached to the upper pulley for tensioning the portion of the cable between the upper pulley and the lower, subsurface location. The tensioned portion of the cable was used as a guide for controlling the travel of the lower pulley. Although the concept of guiding the lower pulley was improved in U.S. Pat. No. 4,098,342 to Robinson et al. and in U.S. Pat. No. 4,271,908 to Robinson, et al., these improved wire-guided loop systems do not completely eliminate fouling of the cable.

Although improved loop systems have been developed to store excess cable in the drill string without fouling the cable, loop systems have several distinct limitations which may be intolerable in commercial drilling operations. First, the drill string cannot be rotated or reciprocated during installation of a loop system. This limitation is undesirable because operators and contractors prefer to continuously move the drill string to lessen the chance of differential-pressure sticking between the drill pipe and the borehole wall. Second, existing loop systems may not be readily retrievable from the drill string in the event that the recovery mechanism should malfunction. In such event, the entire drill string may have to be tripped out of the borehole. If a portion of the loop system should be left in the drill string in an emergency situation, well control efforts could be hindered.

Accordingly, a need exists for a telemetry system which can be modified as the drill string penetrates deeper into the subsurface formations so that slack does not accumulate in the cable. Furthermore, the telemetry system should be capable of being installed during rotation and reciprocation of the drill string and should be fully recoverable from the drill string.

SUMMARY OF THE INVENTION

The present invention furnishes a method of installing and retaining a conductor between a surface terminal and a subsurface location in a drill string used to drill a well. The lower mating end of the conductor is lowered into the drill string by paying out the other, control end of the conductor from the surface until the mating end reaches the subsurface location. The mating end of the conductor is then anchored to the drill string at the subsurface location. The conductor is tensioned to a selected amount by taking in the control end of the conductor, and the control end is connected to the surface terminal.

As a drill pipe section is added to the drill string to advance the depth of the well, the tension of the conductor is controlled by varying the length of the conductor between the subsurface location and the surface terminal. In one embodiment of the invention, tension of the conductor can be increased by taking in the upper end of the conductor through a drill pipe section which is added to the drill string. The tension of the conductor increases because the conductor is elongated by an amount equal to the length of the drill pipe section. In another embodiment of the invention, the tension of the conductor is controlled by connecting a conductor section of a selected length to the conductor as a pipe section is added to the drill string. To increase the tension of the conductor, the length of the conductor section which is added to the conductor is shorter than the length of the drill pipe section which is added to the drill string.

DESCRIPTION OF THE PREFERRED EMBODIMENTS

Figure 1:
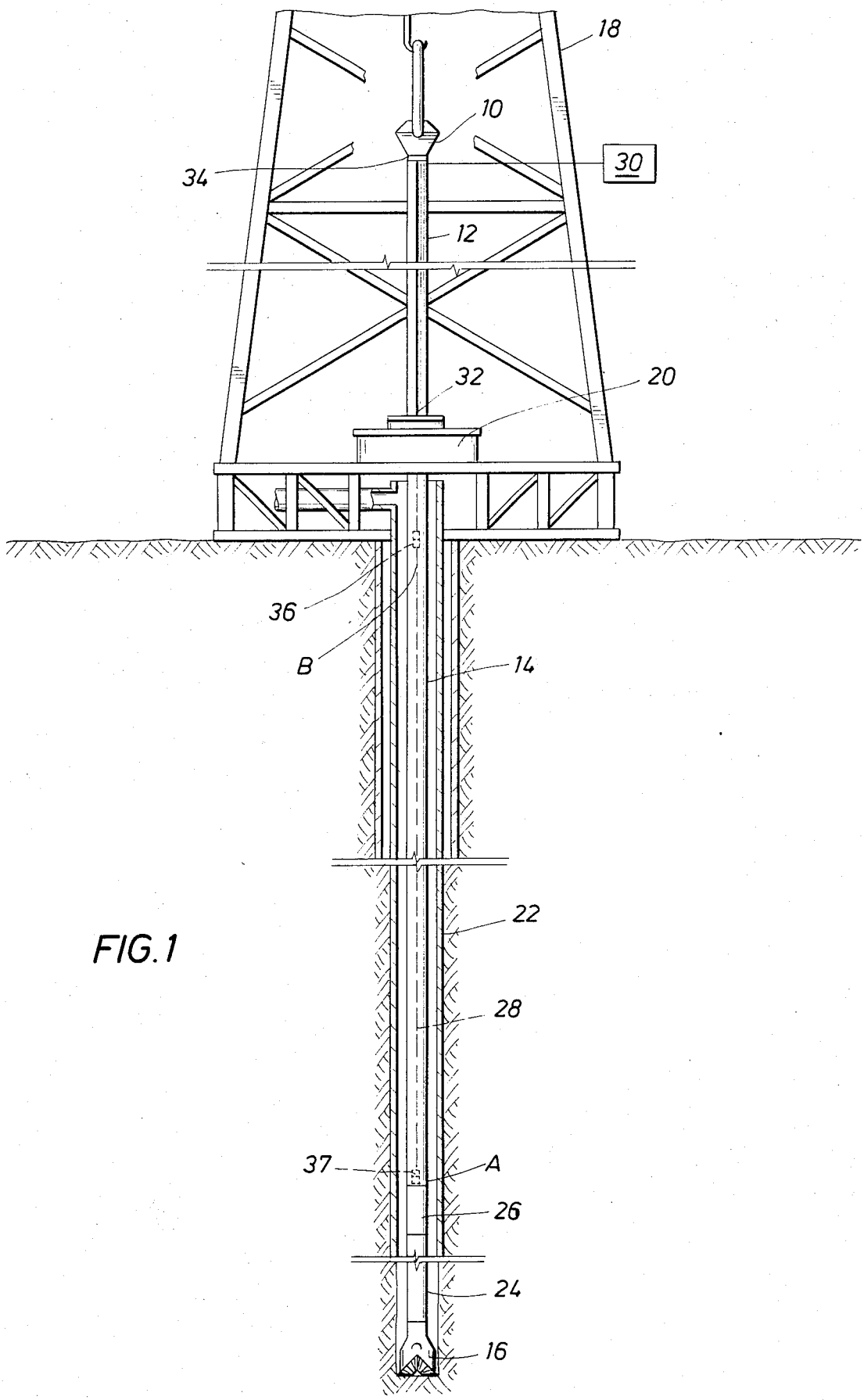
FIG. 1 illustrates a schematic view of the present invention combined with conventional rotary drilling equipment.

Conventional rotary drilling equipment, as illustrated in FIG. 1, includes swivel 10, kelly 12, tubular drill string 14, and bit 16. These components are suspended from drilling derrick 18 by means of rig hoisting equipment (not shown). Kelly 12 passes through rotary table 20 and connects to the upper end of drill string 14. The term "drill string" as used herein refers to the column of tubular drill pipe sections between kelly 12 and bit 16. Each drill pipe section is approximately thirty feet long and generally has an inside diameter in the range of $3\frac{3}{4}$ to $4\frac{1}{2}$ inches. The lower portion of the drill string is typically composed of tubular, thick-walled drill collars having an inside diameter of approximately 2 13/16 inches.

To advance the depth of well 22, drill string 14 and bit 16 are rotated by rotary table 20. As drill string 14 and bit 16 are rotated, drilling fluid is pumped at a rate between 300–1000 gallons per minute down through drill string 14 and up through the wellbore annulus of well 22. The drilling fluid cools and lubricates the bit, removes the rock cuttings from well 22, and furnishes hydrostatic pressure to prevent formation fluids from entering the annulus of well 22.

As mentioned previously, an operator or contractor may desire to monitor a subsurface drilling condition during drilling operations. In telemetry operations, the subsurface condition is measured by downhole equipment at a subsurface location, the data is transmitted to the surface as a signal, and the signal is reduced to a useful form. Referring to FIG. 1, a wellbore telemetry system is illustrated as comprising a subsurface assembly 24, downhole instrument 26, conductor 28 which is suitable for conducting a signal generated by instrument 26, and receiver 30. Instrument 26 can be a surveying instrument for measuring deviation of well 22, a logging instrument for measuring resistivity or other properties of subsurface formations, or a transducer for measuring pressure temperature or strain. Conductor 28 can be an electrical cable for transmitting electrical signals, an optical fiber for carrying light signals, or any other line which is suitable for transmitting signals from instrument 26 to receiver 30. In one embodiment of the invention, conductor 28 can be a composite cable comprising a structural, load-carrying wire which is intertwined or otherwise attached to a signal-carrying electrical cable.

In FIG. 1, conductor 28 has lower mating end A connected to instrument 26 and upper control end B connected to a surface terminal, or kelly conductor 32. Kelly conductor 32 extends through kelly 12 and connects to assembly 34 near the upper end of kelly 12. Assembly 34 comprises a device capable of transmitting a signal from rotating kelly conductor 32 to stationary receiver 30. If the signal is electrical, assembly 34 may be a rotary transformer having a rotor secured to kelly 12 and a stator which is linked to receiver 30. Alternatively, assembly 34 may comprise a slip-ring and brush assembly. In another embodiment, electrical signals could be transmitted from kelly conductor 32 to receiver 30 by a wireless transmitter.

Wellbore telemetry operations are usually initiated after drilling has progressed to a particular depth. Before conductor 28 is installed between kelly conductor 32 and the desired subsurface location, regular drilling operations should be temporarily interrupted. Even though regular drilling operations are stopped, the operator can continue to move drill string 14 to minimize differential-pressure sticking of drill string 14. To install conductor 28 between the subsurface location in the drill string and the wellbore, instrument 26 is connected to mating end A of conductor 28 and is lowered into drill string 14 by paying out control end B of conductor 28 from a storage drum (not shown) at the surface. As is well-known in the art, a sheave (not shown) located above the floor of derrick 18 may be useful in guiding conductor 28 into drill string 14. As conductor 28 is unreeled from the drum, instrument 26 and mating end A of conductor 28 are lowered until they reach the desired subsurface location. Instrument 26 and attached mating end A are then anchored to drill string 14 at the subsurface location by a conventional locking sub or latch. In another embodiment of the invention, instrument 26 can be permanently installed in drill string 14. In this embodiment, mating end A of conductor 28 is lowered into the drill string as set forth above and is then anchored to instrument 26 and attached drill string 14 at the desired subsurface location.

Once mating end A of conductor 28 has been anchored to drill string 14 at the subsurface location, conductor 28 is tensioned by taking in control end B of conductor 28 with the storage drum (not shown). By tensioning conductor 28, the most common cause of cable failure may be substantially reduced if not eliminated. Tests have demonstrated that an untensioned cable will vibrate due to forces induced by the flow of drilling fluid through a drill string. The vibration may foul the cable or may fray the individual strands of the cable into a "bird's-nest". In an armored logging cable comprising an electrical conductor insulated from an outer structural armor, the vibration may fatigue the cable until the electrical conductor is damaged or the entire cable parts.

The most severe damage in an untensioned conductor usually occurs near the lower end of the conductor. In an untensioned conductor hanging free from a connection on a drilling rig, the upper portion of the conductor will be in tension due to the weight of the lower portion of the conductor. Because the lower end of the conductor does not support any weight and is therefore completely untensioned, the conductor will typically vibrate and fail at the point where the lower end of the conductor is anchored to the drill string. By tensioning the entire length of conductor 28, Applicant's invention significantly reduces the possibility of damage to the lower end of the conductor.

The appropriate force used to tension conductor 28 will vary according to factors such as the type of conductor material used, the dimensions of the conductor, the geometry of the well, and drilling parameters. The tension of the conductor at its lower end should be great enough to reduce damage due to fatigue. Therefore, the force tensioning the conductor must exceed the downward frictional force exerted on the conductor as the drilling fluid is pumped down the drill string. However, the force tensioning the conductor should not be so great as to exceed the yield strength or the ultimate tensile strength of the conductor. Therefore, the tension of conductor 28 is preferably controlled within an appropriate operating range to prevent failure of conductor 28. To prevent failure of the conductor at its upper end, the conductor may be tapered in a stepwise fashion so that its upper end is larger in diameter than the lower end of the conductor.

Because the structural component of conductor 28 is preferably manufactured from a material such as steel which elastically deforms when placed in tension, conductor 28 will lengthen in response to a tensile force. As disclosed by Applicant's invention, the tension of conductor 28 can be controlled by varying the length of conductor 28 which is installed between the subsurface location and kelly conductor 32. In one embodiment of Applicant's invention, the length required for conductor 28 at a desired tension between the subsurface location and kelly conductor 32 can be determined by calculating relevant factors such as the elasticity coefficient, thermal elongation coefficient, and weight of conductor 28. Moreover, other factors such as pipe squat and the drag induced by the drilling fluid should also be considered in the calculations.

Once the appropriate length of conductor 28 has been determined, connector plug 36 is attached to control end B and connector plug 37 is attached to mating end A of conductor 28. Mating end A of conductor 28 and plug 37 are lowered into drill string 14 and are anchored to drill string 14 at the subsurface location. Control end B of conductor 28 is then taken in from the surface to tension conductor 28. If desired, the tension of conductor 28 can be measured with an instrumented tension board or other suitable force measuring instrument. Plug 36 at control end B of conductor 28 is connected to kelly conductor 32. Kelly 12 is then connected to the upper end of drill string 14, and normal drilling operations are resumed.

In certain wells, it may not be desirable to precut the conductor before the conductor is installed in the drill string. In an alternative embodiment of the invention, conductor 28 can be installed without predetermining the appropriate conductor length. Initially, conductor 28 may be wound on a storage drum (not shown). Mating end A of conductor 28 and plug 37 are lowered into drill string 14 and are anchored to the subsurface location as previously described. Conductor 28 is then tensioned to the desired amount by taking in control end B with the storage drum. Next, conductor 28 is marked at a point above the upper end of drill string 14 and is then slackened so that mating end A of conductor 28 can be disconnected from drill string 14 at the subsurface location. Conductor 28 is then taken in by the storage drum until the mark is above the upper end of drill string 14 and conductor 28 is severed at the marked point. Plug 36 is connected to the severed end and a cable extension (not shown) is attached to plug 36. Mating end A of conductor 28 is reanchored to drill string 14 at the subsurface location, conductor 28 is retensioned until plug 36 is located above the upper end of drill string 14, and the cable extension is removed. Plug 36 is then connected to kelly conductor 32 as previously described.

In normal drilling operations, the depth of the well is advanced in increments corresponding to the length of each pipe section added to the upper end of the drill string. In a preferred embodiment of the invention, a conductor section is connected between conductor 28 and kelly conductor 32 to control the tension of conductor 28 as drill string 14 is lengthened by adding a new pipe section.

Figure 2:
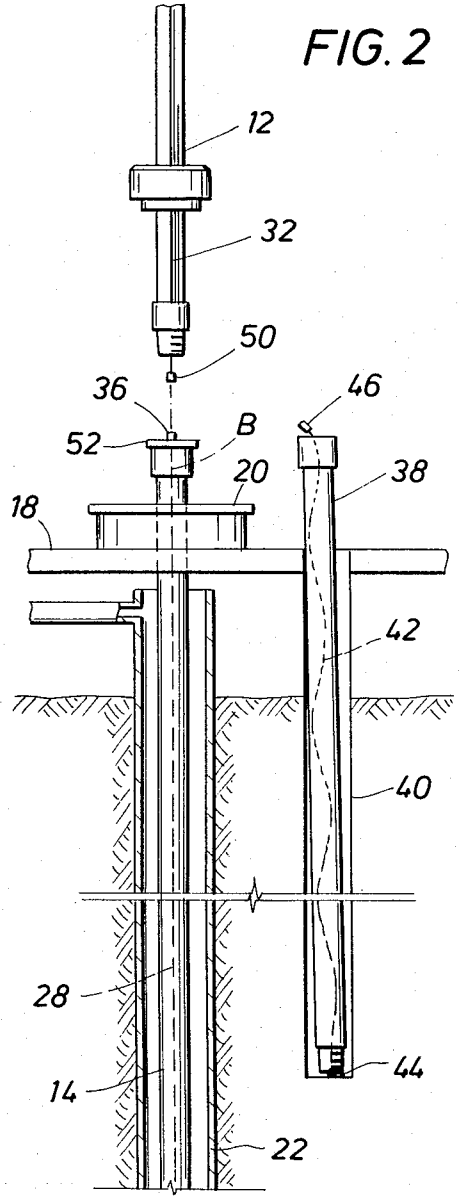

Referring to FIG. 2, the lower end of pipe section 38 is located in mouse hole 40 below the floor of derrick 18. Conductor section 42, having connector plugs 44 and 46 at its opposite ends, is placed into pipe section 38. Plug 44 is adapted to mate with plug 36 at the upper, control end B of conductor 28, and plug 46 is adapted to mate with lower terminal plug 50 of kelly conductor 32. To lengthen drill string 14 and conductor 28, drill string 14 is suspended in rotary table 20. Kelly 12 is disconnected from drill string 14, and kelly 12 is raised so that plug 36 at control end B is pulled above the upper end of drill string 14. A grip means such as support plate 52 is inserted between plug 36 and the upper end of drill string 14 to grasp control end B of conductor 28 and to maintain tension therein. Plug 50 and plug 36 are then disconnected as illustrated in FIG. 2.

Figure 4:
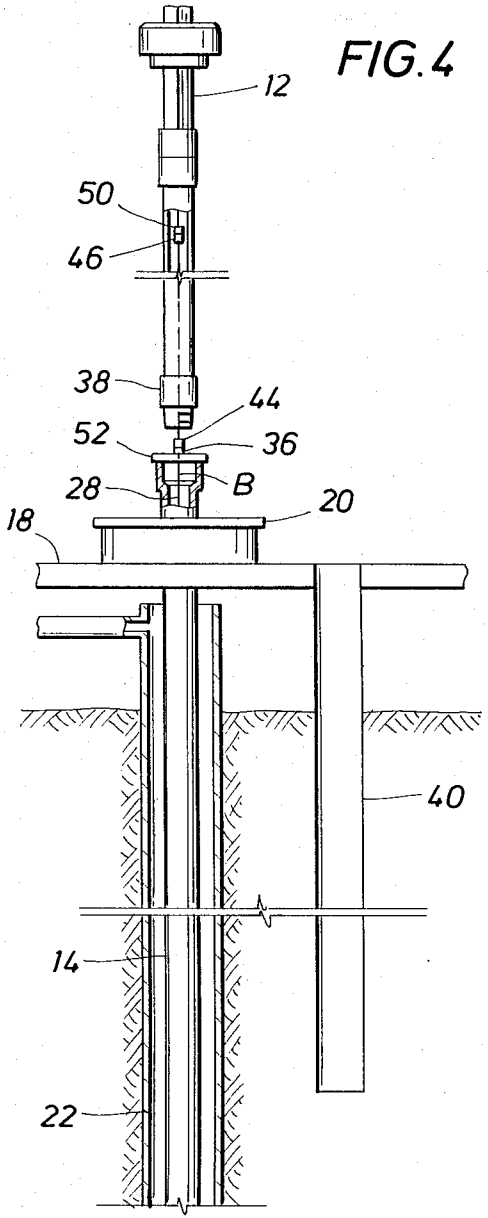
FIGS. 2–5 illustrate sequential steps in lengthening the drill string and the conductor.
Figure 3:
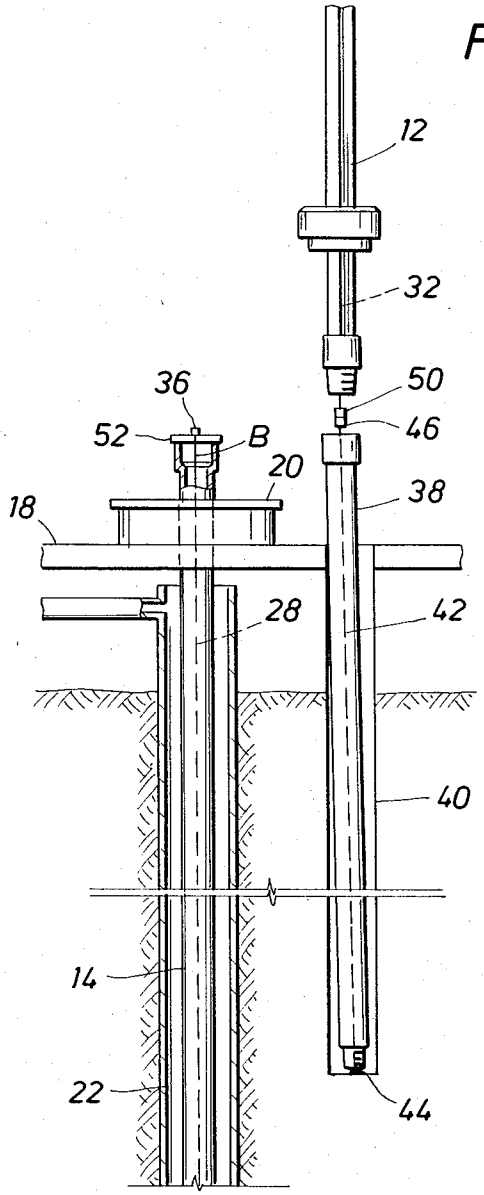
Figure 5:
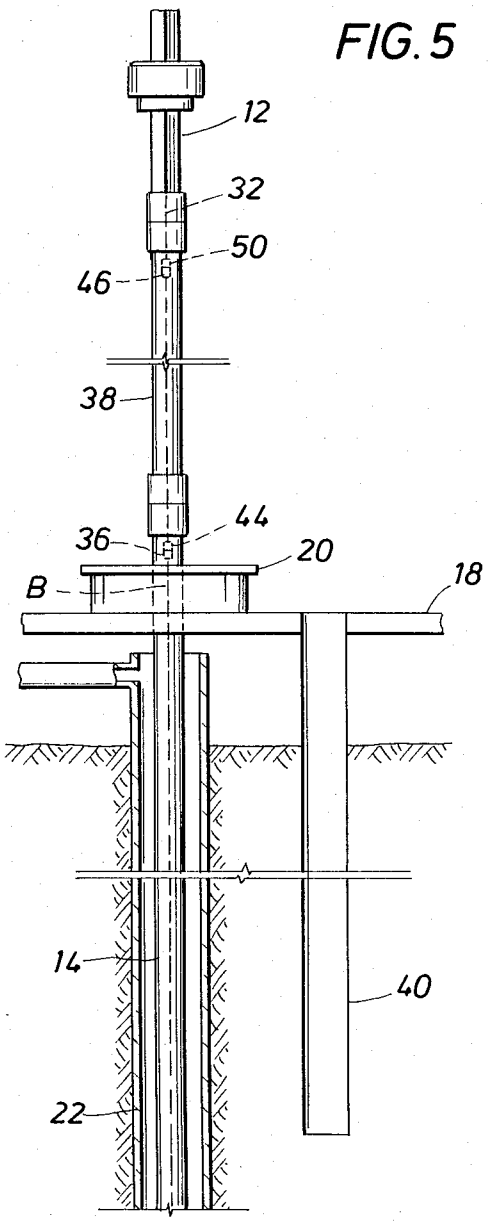

Referring to FIG. 3, kelly 12 is moved into axial alignment with pipe section 38, and plug 50 is connected to plug 46. Kelly 12 is then connected to pipe section 38, and pipe section 38 is elevated above drill string 14 by raising kelly 12 as is illustrated in FIG. 4. Plug 44 is connected to plug 36, kelly 12 is raised to tension conductor 28, and support plate 52 is removed. The lower end of pipe section 38 is connected to and becomes a part of drill string 14 as illustrated in FIG. 5. Drilling operations may then be resumed. Because conductor section 42 in the foregoing description is longer than pipe section 38, conductor 28 will be lengthened by an amount greater than the portion of drill string 14 between the subsurface location and kelly 12. Therefore, the addition of conductor section 42 will reduce the tension of conductor 28.

The foregoing procedure can be repeated to advance the depth of well 22. As additional conductor sections and drill pipe sections are added to respectively increase the lengths of conductor 28 and drill string 14, the tension of conductor 28 will be reduced until the tension approaches a minimum acceptable amount. At this point, the tension of conductor 28 can be increased as an additional pipe section is connected to drill string 14 by adding a conductor section which is shorter than the length of the corresponding pipe section.

Figure 7:
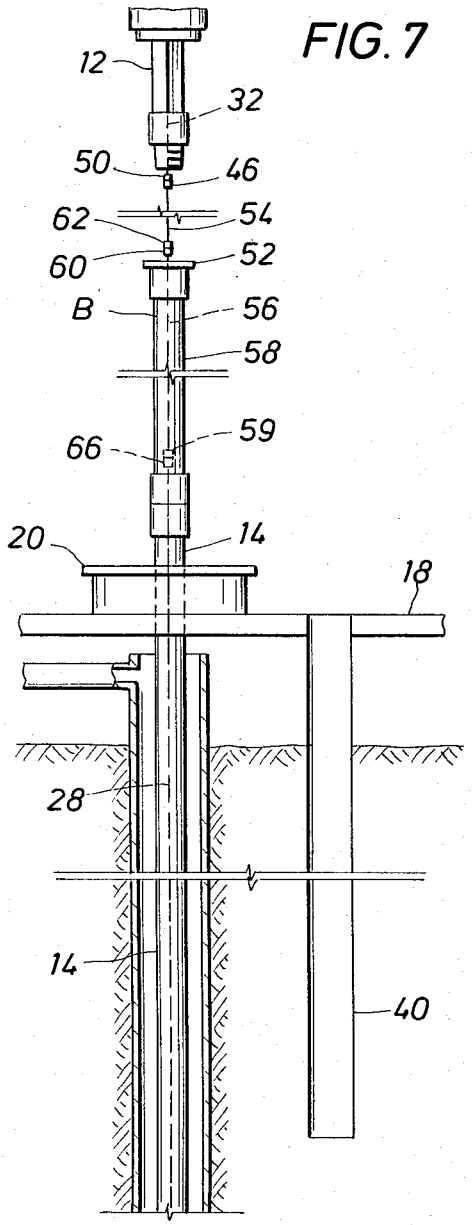
FIGS. 6–7 illustrates a method of connecting a conductor section to the conductor when the conductor section is shorter than the drill pipe section being added to the drill string.
Figure 6:
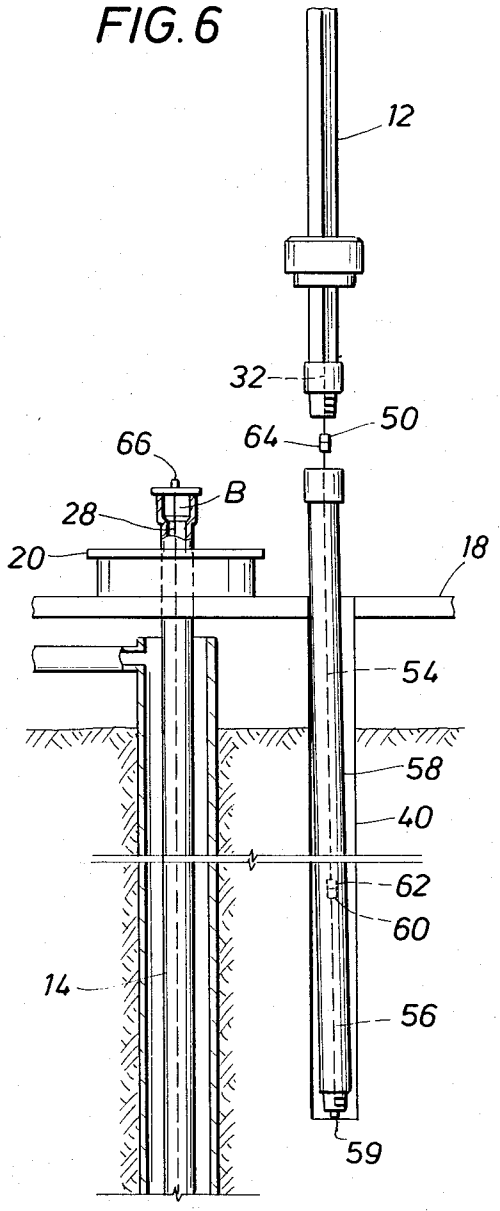

Referring to FIG. 6, conductor extension 54 is connected between kelly conductor 32 and the upper end of conductor section 56. Extension 54 is sufficiently long to permit the lower end of conductor section 56 to extend through the lower end of pipe section 58. Conductor section 56 has plug 59 at its lower end and plug 60 at its upper end. Plug 62 at the lower end of extension 54 is connected to plug 60, and plug 64 at the upper end of extension 54 is connected to plug 50 of kelly conductor 32. Conductor section 56 is threaded through pipe section 58 so that plug 59 extends through the lower end of pipe section 58, and kelly 12 is connected to the upper end of pipe section 58. Kelly 12 and attached pipe section 58 are raised into axial alignment with the upper end of drill string 14, and plug 59 is connected to plug 66 at the upper control end B of conductor 28. As illustrated in FIG. 7, the lower end of pipe section 58 is added to drill string 14 to extend the length of drill string 14, and kelly 12 is disconnected from the upper end of pipe section 58. Kelly 12 is raised to tension conductor 28 until extension 54 and plug 60 at the upper end of conductor section 56 are located above the upper end of extended drill string 14. Support plate 52 is then placed under plug 60 to support conductor 28, kelly 12 is lowered to slacken extension 54, and extension 54 is removed. Plug 50 of kelly conductor 32 is then connected to plug 60 at upper control end B of conductor 28, kelly 12 is raised to permit removal of support plate 52, and kelly 12 is connected to extended drill string 14. The tension of conductor 28 is increased by reducing the length of conductor 28 relative to the length of added pipe section 58. Thereafter, normal drilling operations can be resumed.

As previously discussed, the tension of conductor 28 can be controlled as pipe sections are added to the drill string by adding conductor sections to the conductor which are longer or shorter than the corresponding pipe section. By measuring the tension of conductor 28 before a new conductor section is added and by accounting for various factors which will affect the tension of conductor 28, the length of the appropriate conductor section can be selected before the conductor section is added to extend the length of conductor 28. In one embodiment of Applicant's invention, the tension of conductor 28 can be increased by adding a pipe section to the drill string without adding a corresponding conductor section. This can be accomplished by using a conductor extension temporarily attached to the conductor in a fashion similar to that shown in FIGS. 6 and 7 and as described more thoroughly above.

The present invention furnishes a significant improvement over wireline telemetry systems currently used because the system does not require complicated conductor storage mechanisms which are difficult to install and use. By utilizing the elastic properties of the conductor, the tension of the conductor is controlled within an appropriate operating range as drill pipe sections are added to extend the length of the drill string. Because the entire conductor can be recovered from the drill string through usual procedures, emergency operations are not impeded by obstructions which are left in the drill string. By tensioning the entire length of the conductor, the present invention prevents fatigue failure of the conductor which is induced by the drilling fluid and rotation of the drill string. As previously set forth, a multiple line conductor comprised of a structural, load-bearing armor attached to a signal transmission wire such as a multiple conductor electrical cable or fiber-optics bundle can be used in place of a single-conductor transmission wire. Because all operations are controlled from the surface, the invention can be implemented with minimum disruption of normal drilling operations.

What is claimed is:

1. A method of installing and retaining a conductor between a surface terminal and a subsurface location in a drill string used to drill a well, comprising the steps of:

lowering a mating end of the conductor into the drill string by paying out the conductor from its other, control end until the mating end reaches the subsurface location;

anchoring the mating end of the conductor to the drill string at the subsurface location;

tensioning the conductor;

measuring the tension of the conductor;

connecting the control end of the conductor to the surface terminal; and controlling the tension of the conductor, as a drill pipe section is added to the drill string to advance the depth of the well, by connecting a conductor section between the surface terminal and the control end of the conductor, wherein the length of the conductor section at a tension corresponding to the measured tension of the conductor is less than the length of the pipe section to be added to the drill string.

2. A method of installing and retaining a conductor between a surface terminal and a subsurface location in a drill string used to drill a well, comprising the steps of:

lowering a mating end of the conductor into the drill string by paying out the conductor from its other, control end until the mating end reaches the subsurface location;

anchoring the mating end of the conductor to the drill string at the subsurface location;

tensioning the conductor;

grasping the conductor with a grip means at a point between the upper end of the drill string and the control end of the conductor to hold the conductor in the drill string in tension;

severing the conductor at a point between the grip means and the control end of the conductor;

attaching the surface terminal to the severed end of the conductor held in tension by the grip means;

removing the grip means from the conductor; and controlling the tension of the conductor, as a drill pipe section is added to the drill string to advance the depth of the well, by connecting a conductor section of a selected length between the surface terminal and the control end of the conductor.

3. A method as recited in claim 2, further comprising the step of attaching a plug to the severed control end of the conductor before the control end is attached to the surface terminal.

4. A method as recited in claim 2, further comprising the step of measuring the tension of the conductor before the conductor section is connected between the surface terminal and the control end of the conductor.

5. A method as recited in claim 4, wherein the length of the conductor section to be connected between the surface terminal and the control end of the conductor is greater than the length of the pipe section to be added to the drill string.

6. A method as recited in claim 4, wherein the length of the conductor section at a tension corresponding to the measured tension of the conductor is less than the length of the pipe section to be added to the drill string.

7. A method of installing and retaining a conductor between a surface terminal and a subsurface location in a drill string used to drill a well, wherein the conductor has a control end which can be manipulated at the surface and has a mating end which is initially anchored to the drill string at the subsurface location, comprising the steps of:

taking in the control end of the conductor to tension the conductor to a selected amount;

marking the conductor at a point between the upper end of the drill string and the control end of the conductor;

disconnecting the mating end of the conductor from the subsurface location in the drill string;

severing the conductor at its marked point;

reanchoring the mating end of the conductor to the drill string at the subsurface location;

retensioning the conductor;

attaching the severed control end of the tensioned conductor to the surface terminal; and controlling the tension of the conductor, as a drill string section is added to the drill string to advance the depth of the well, by connecting a conductor section of a selected length between the surface terminal and the control end of the conductor.

8. A method as recited in claim 7, further comprising the step of attaching a plug to the severed control end of the conductor before the control end is attached to the surface terminal.

9. A method as recited in claim 7, further comprising the step of measuring the tension of the conductor before the conductor section is connected between the surface terminal and the control end of the conductor.

10. A method as recited in claim 9, wherein the length of the conductor section to be connected between the surface terminal and the control end of the conductor is greater than the length of the pipe section to be added to the drill string.

11. A method as recited in claim 9, wherein the length of the conductor section at a tension corresponding to the measured tension of the conductor is less than the length of the pipe section to be added to the drill string.

12. A method for increasing the tension in a conductor, which is connected between a subsurface location in a drill string used to drill a well and a kelly at the surface, as a drill pipe section is added between the kelly and the drill string to advance the depth of the well, comprising the steps of:

disconnecting the kelly from the drill string;

grasping the upper end of the conductor with a grip means to hold the conductor in tension;

disconnecting the control end of the conductor from the kelly;

threading a conductor extension through the drill pipe section until the lower and upper ends of the conductor extension extend through the drill pipe section;

connecting the lower end of the conductor extension to the upper end of the conductor;

removing the grip means from the conductor;

connecting the drill pipe section to the drill string to extend the length of the drill string;

taking in the upper end of the conductor extension until the upper end of the conductor extends above the upper end of the extended drill string;

removing the conductor extension from the conductor;

attaching the upper end of the conductor to the kelly; and connecting the kelly to the upper end of the extended drill string.

13. A method as recited in claim 12, further comprising the step of measuring the tension of the conductor before the conductor extension is attached to the upper end of the conductor.

14. A method as recited in claim 12, wherein the conductor extension is taken in by attaching the upper end of the conductor extension to the kelly and by raising the kelly until the upper end of the conductor extends above the upper end of the extended drill string.

15. A method for increasing the tension in a conductor, which is connected between a subsurface location in a drill string used to drill a well and a kelly at the surface, as an additional drill pipe section is added between the kelly and the drill string to advance the depth of the well, comprising the steps of:

disconnecting the kelly from the drill string;

grasping the upper end of the conductor with a grip means to hold the conductor in tension;

disconnecting the control end of the conductor from the kelly;

measuring the tension of the conductor;

connecting a conductor extension to a conductor section of a length which is less than the length of the drill pipe section to be added to the drill string, wherein the combined length of the conductor section and conductor extension is greater than the length of the drill pipe section;

threading the conductor section through the drill pipe section until the lower end of the conductor section and the upper end of the conductor extension each extend through the drill pipe section;

connecting the lower end of the conductor section to the upper end of the conductor;

removing the grip means from the conductor;

connecting the drill pipe section to the drill string to extend the length of the drill string;

taking in the conductor extension until the upper end of the conductor section extends above the upper end of the extended drill string;

removing the conductor extension from the conductor section;

attaching the upper end of the conductor section to the kelly; and connecting the kelly to the upper end of the extended drill string.

* * * * *